United States Patent [19]

Bloom

[11] Patent Number: 4,464,601

[45] Date of Patent: Aug. 7, 1984

[54] CRT WITH QUADRUPOLAR-FOCUSING COLOR-SELECTION STRUCTURE

[75] Inventor: Stanley Bloom, Bridgewater, N.J.

[73] Assignee: RCA Corporation, New York, N.Y.

[21] Appl. No.: 407,276

[22] Filed: Aug. 11, 1982

[51] Int. Cl.[3] ..... H01J 29/07

[52] U.S. Cl. ..... 313/403; 313/408

[58] Field of Search ..... 313/403, 408, 402; 315/375

[56] References Cited

U.S. PATENT DOCUMENTS

| | | | |
|---|---|---|---|
| 4,059,781 | 11/1977 | van Alphen et al. | 313/403 |
| 4,207,490 | 6/1980 | Van der Ven | 313/403 |
| 4,311,944 | 1/1982 | Bloom et al. | 315/375 |
| 4,316,126 | 2/1982 | Hockings et al. | 315/375 |
| 4,350,922 | 9/1982 | Catanese et al. | 313/402 |
| 4,427,918 | 1/1984 | Lipp | 313/403 X |

FOREIGN PATENT DOCUMENTS

| | | | |
|---|---|---|---|
| 69650 | 4/1982 | Japan | 313/402 |

*Primary Examiner*—Palmer C. Demeo

*Attorney, Agent, or Firm*—E. M. Whitacre; D. H. Irlbeck; L. Greenspan

[57] ABSTRACT

CRT employs a quadrupolar-focusing color-selection structure comprising two or more apertured masking plates. Each plate has therein an array of substantially rectangular apertures which are positioned relative to one another to produce electrostatic quadrupolar-focusing lenses when operating voltages are applied thereto. The color-selection structure may, by its geometry, provide at the same time electrostatic dipolar deflecting fields when operating voltages are applied.

8 Claims, 8 Drawing Figures

CRT WITH QUADRUPOLAR-FOCUSING COLOR-SELECTION STRUCTURE

BACKGROUND OF THE INVENTION

This invention relates to a novel focus-mask-type CRT (cathode-ray tube). The CRT comprises a color-selection structure which, when operating voltages are applied thereto, produces a plurality of substantially rectangular quadrupolar-focusing lenses therein and may also produce a related array of dipolar-deflection lenses therein. In this document, as in the prior art, "square" is included within the meaning of "rectangular."

CRTs with quadrupolar-focusing color-selection structures have been described previously as embodied in a two-layer structure in U.S. Pat. No. 4,059,781 issued Nov. 22, 1977 to W. M. van Alphen et al. and as a three-layer structure in U.S. patent application Ser. No. 161,603 filed June 20, 1980 by C. A. Catanese et al. The color-selection structures of these prior CRTs each comprise at least one set of parallel conductors held in position to another array of parallel conductors or to an apertured masking plate by solid insulators. CRTs with dipolar-deflecting-and-quadrupolar-focusing lenses have been described previously as embodied in a two-layer structure in U.S. Pat. No. 4,207,490 issued June 10, 1980 to R. F. Van der Ven and U.S. Pat. No. 4,316,126 issued Feb. 16, 1982 to E. F. Hockings et al. and in a three-layer structure in U.S. Pat. No. 4,311,944 issued Jan. 19, 1982 to S. Bloom et al. The color-selection structures of these prior CRTs each comprise at least one set of parallel conductors held in position with respect to an apertured masking plate by solid insulators.

In all of the prior quadrupolar-focusing color-selection structures, the parallel conductors are individual pieces, such as metal strips or metal wires, that are separately attached to the structure with solid insulators. This separateness presents a major fabrication problem of precisely positioning and attaching the many individual pieces, and major operational problem of maintaining the relative positions of these many pieces with respect to the other parts of the structure.

The prior structures produce substantially rectangular quadrupolar lenses in rectangular openings in the color-selection structure. Where an apertured masking plate comprises the structure, the rectangular apertures therein have been produced by etching a metal layer. Such etching process produces apertures with rounded corners, which are less desirable than the desired unrounded corners.

SUMMARY OF THE INVENTION

The novel CRT employs a quadrupolar-focusing color-selection structure positioned in the CRT as in prior tubes. Unlike prior tubes, the novel CRT employs a quadrupolar-focusing color-selection structure comprised of two or more apertured masking plates insulatingly spaced from one another with solid insulators. Each masking plate has therein an array of substantially rectangular apertures which are positioned relative to one another to produce substantially rectangular electrostatic quadrupolar-focusing lenses when operating voltages are applied thereto.

Each masking plate is a single metal layer consisting essentially of a first plurality of spaced parallel webs and a second plurality of spaced parallel webs orthogonal to the first plurality of webs, which webs define the apertures through the masking plates. One of the plurality of webs in at least one of the masking plates is electron-optically innocuous when operating voltages are applied to the color-selection structure; that is, the electric fields produced from these webs are very much smaller than the other fields that are present and have little or no effect upon electrons passing through the aperture. These webs are relatively smaller physically, being less than one half the widths of the other webs in the masking plate.

DETAILED DESCRIPTION OF THE PREFERRED EMBODIMENT

Figure 1:
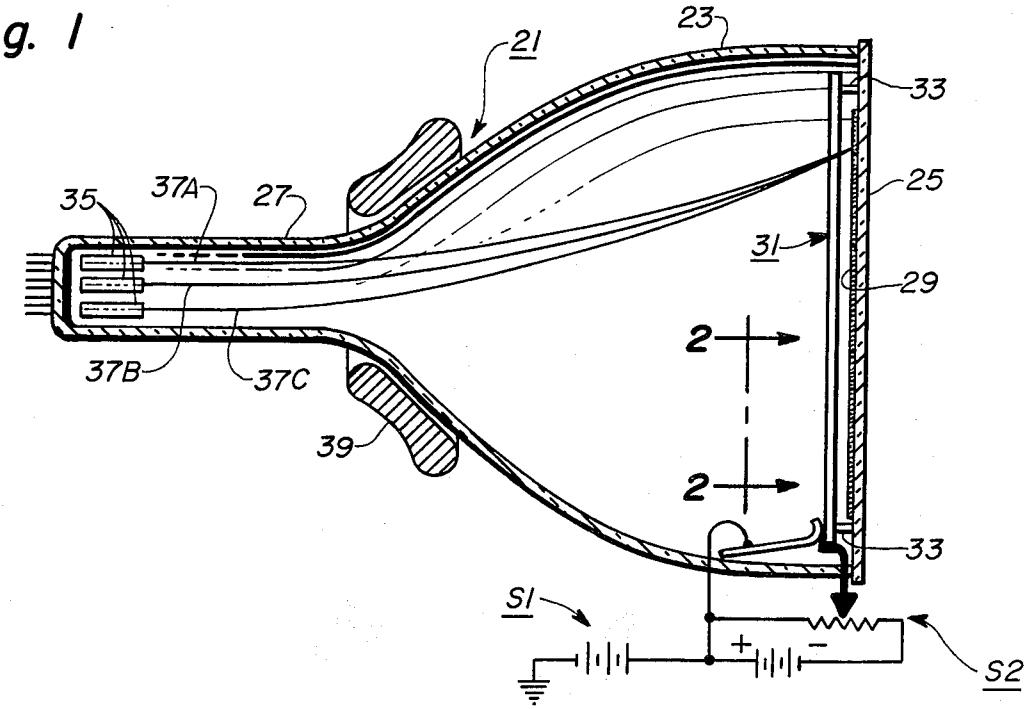
FIG. 1 is a partially-schematic sectional view of an embodiment of a novel CRT.

The novel color television picture tube 21 shown in FIG. 1 comprises an evacuated bulb 23 including a transparent faceplate 25 at one end and a neck 27 at the other end. The faceplate 25, which is flat, but may arch outwardly, supports a luminescent viewing screen or target 29 on its inner surface. Also, a first color-selection structure 31 is supported from three supports 33 on the inside surface of the faceplate 25. Means 35 for generating three electron beams 37A, 37B and 37C are housed in the neck 27. The beams are generated in substantially a plane, which is preferably horizontal in the normal viewing position. The beams are directed towards the screen 29 with the outer beams 37A and 37C convergent on the center beam 37B at the color-selection structure 31. The three beams are deflected by magnetic fields from deflection coils 39 to scan a raster over the color-selection structure 31 and the viewing screen 29.

Figure 2:
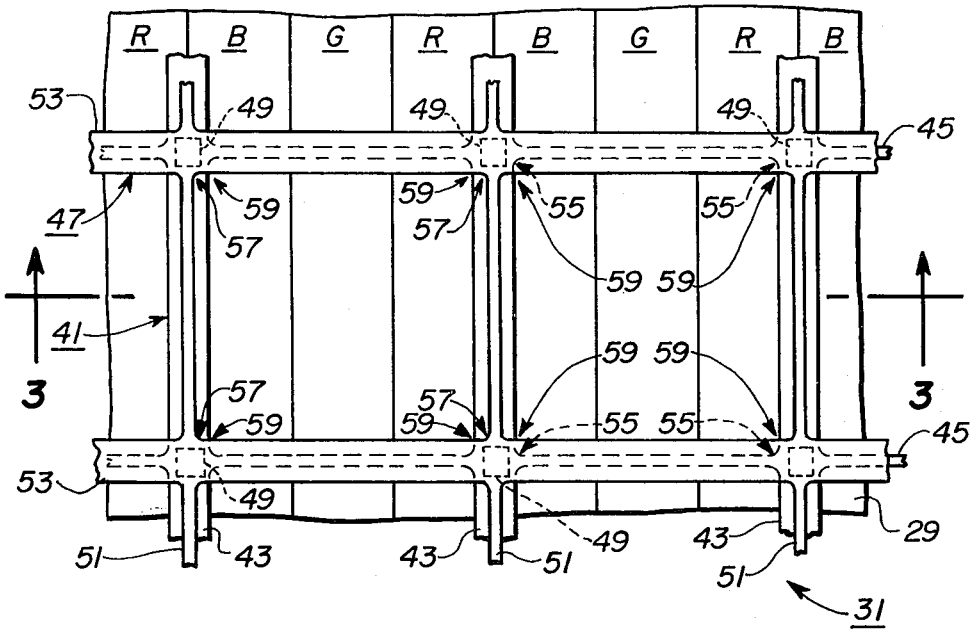
FIG. 2 is a plan view of fragments of the two-layer quadrupolar-focusing color-selection structure and the viewing screen of the CRT shown in FIG. 1 viewed as shown by 2—2 in FIG. 1.
Figure 3:
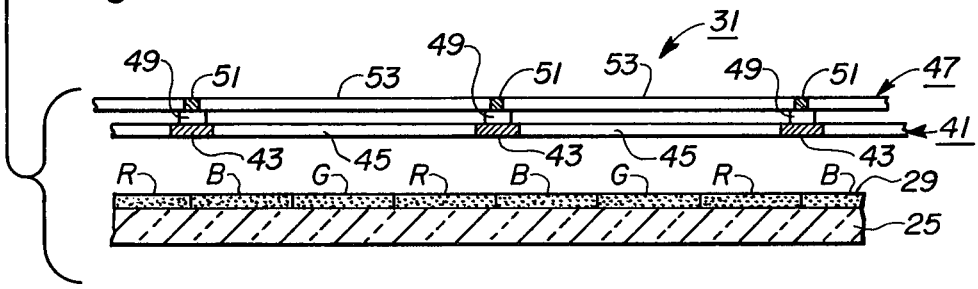
FIG. 3 is a sectional view of the fragment shown in FIG. 2 viewed along section lines 3—3.

The viewing screen 29 and the color-selection structure 31 are described in more detail with respect to FIGS. 2 and 3. The viewing screen 29 comprises a large number of red-emitting, green-emitting and blue-emitting phosphor stripes R, G and B respectively, arranged in color groups of three stripes or triads in a cyclic order and extending in a direction which is generally normal to the plane in which the electron beams are generated. In the normal viewing position for this embodiment, the phosphor stripes extend in the vertical direction.

The color-selection structure 31 of this first embodiment comprises a first masking plate 41 facing and precisely spaced from the viewing screen 29. The first masking plate 41 has a large number of first rectangular openings or apertures therein defined by first vertical webs 43 which are about 0.75 mm (30 mils) on center and, orthogonal thereto, horizontal webs 45 which are about 0.75 mm (30 mils) on center. The first apertures are arranged in columns, which are parallel to the long direction of the phosphor stripes R, G and B, there being one column of first apertures associated with each triad of stripes. The green stripe G is at the center of each triad, and is centered opposite its associated column of apertures, and the first vertical webs 43 are centered over the boundaries between the triads. A red stripe R is to one side and a blue stripe B is to the other side of each green stripe G.

The color-selection structure 31 also comprises a second masking plate 47 spaced from the first masking plate 41 by solid insulators 49 that are of the order of 0.025 to 0.050 mm (1 to 2 mils) thick. The second masking plate 47 has a large number of second rectangular openings or apertures therein defined by second vertical webs 51 which are about 0.75 mm (30 mils) on center and, orthogonal thereto, second horizontal webs 53 which are about 0.75 mm (30 mils) on center. The centers of the second vertical webs 51 are opposite the centers of the first vertical webs 43 and the boundaries between the triads. The centers of the second horizontal webs 53 are opposite the centers of the first horizontal webs 45. In this embodiment, the first and second masking plates are each about 0.10 mm (4 mils) thick. The first horizontal webs 45 and the second vertical webs 51 are each about 0.025 mm (1 mil) wide. The second horizontal webs 53 and the first vertical webs 43 are each about 0.10 mm (4 mils) wide. The insulators 49 are less than 0.10 mm (4 mils) at their greatest horizontal and vertical dimensions.

Because of the foregoing geometric and dimensional relationships, the first color-selection structure 31 has therein, in parallel vertical columns, an array of windows which are defined by the first vertical webs 43 and the second horizontal webs 53. The windows are functionally electron-beam-transmitting ports. The corners 55 of the first apertures and the corners 57 of the second apertures are each unavoidably rounded to some extent because of the process used to prepare them. However, because of the aforementioned geometry, the corners 59 of the windows through the color-selection structure are sharp, without any rounding. This produces a more uniform quadrupolar focusing electric field, and thence a beam spot with a straighter vertical edge, when operating voltages are applied to the color-selection structure 31.

All of the sizes disclosed herein for the color-selection structure are exemplary and may be varied to enhance one or more performance characteristics of the CRT. The windows through the color-selection structure 31 are uniformly sized but may be, if desired, graded in size from the center to the edge of the masking plate 41. Also, the spacing between the first masking plate 41 and the stripes R, G and B is uniform but may be graded from the center to the edge of the masking plate 41. In another alternative, windows in adjacent columns may be vertically offset from one another instead of being in a horizontal line or row as shown in FIG. 2. To improve the light output of the target, the surfaces of the stripes R, G, and B towards the electron-producing means may be coated with a light-reflective material, such as aluminum metal.

To operate the tube 21, the electron-beam-producing means 35 shown in FIG. 1 is energized with the cathode at essentially ground potential. A first positive voltage (V) of about 25,000 volts from a voltage source S1 is applied to the screen and to the second masking plate 47, and a second positive voltage ($V-\Delta V$) of about 25,000 volts minus an optimized focusing voltage ($\Delta V$) which is usually about 500 volts from a source S2 is applied to the first masking plate 41. Three convergent beams 37A, 37B and 37C from the means 25 are made to scan a raster on the viewing screen 29 with the aid of magnetic field produced by the deflection coils 39. The beams approach the first masking plate 41 at different but definite angles. Each beam is much wider than the apertures and therefore spans many apertures. Each beam produces many beamlets, which are the portions of the beam which pass through the windows and excite the phosphor stripes.

The electrostatic fields produced by the voltages on the webs 43 and 53 cause those beamlets that pass through the windows to be compressed or focused normal to the direction of the first vertical webs 43 and expanded or defocused normal to the direction of the second horizontal webs 53. The electrostatic fields produced by the voltages on the first horizontal webs 45 and the second vertical webs 51 are masked or otherwise rendered innocuous and of little or no effect on the beamlets. Because of the spacing between the combination of masking plates 41 and 47 and the stripes R, G and B in combination with the different convergent angles, the beamlets produced by each beam all fall on phosphor stripes of the same emission color. The same deflection and focusing occurs at all of the windows as the center beam 37B scans across the viewing screen 29. Similarly, but at a different angle, one side beam 37A produces beamlets which fall only on red-emitting stripes R; and the other side beam 37C produces beamlets which fall only on blue-emitting stripes B.

The foregoing operation is to be compared with the CRT and the mode of operation disclosed in U.S. Pat. No. 4,059,781 to W. M. van Alphen et al. In those prior structures, at least one set of parallel-spaced conductors is employed as separate pieces. Separate pieces are more difficult to position in the color-selection structure and to maintain their relative positions during the operation of the tube than are the corresponding webs in the novel tube. In the first embodiment of the color-selection structure, there are no separate conductors. Instead, each array of conductors is replaced with a complete masking plate comprising an integral grid of webs, which plate is fabricated more easily and the webs therein maintain their relative positions more precisely because of the integral character of the masking plate. Nevertheless, during operation, because of the relative widths of the webs, the electric fields from the narrower webs have little or no effect on the beamlets that pass through the color-selection structure.

Figure 4:
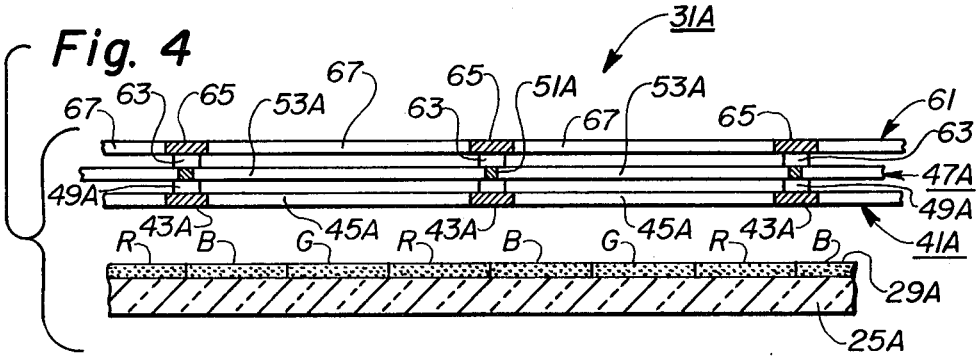
FIG. 4 is a sectional view of the fragments of a three-layer quadrupolar-focusing color-selection structure and viewing screen that may be substituted in the CRT shown in FIG. 1.

An alternative three-layer construction of the quadrupolar-focusing color-selection structure 31A for the novel CRT is shown in FIG. 4 as a second embodiment. This structure is similar to the first embodiment shown in FIG. 3 except that a third masking plate 61 is spaced from the second masking plate 47A by solid insulators 63 that are about 0.025 to 0.050 mm (1 to 2 mils) thick.

In FIG. 4, structural parts that are similar to those in FIGS. 2 and 3 bear the same reference numeral followed by an A. The third masking plate 61 is substantially identical in design to the first masking plate 41A, having a large number of third rectangular openings or apertures therein which are defined by first wide (0.10 mm) vertical webs 65 about 0.75 mm on center and, orthogonal thereto, narrow (0.025 mm) horizontal webs 67 about 0.75 mm on center.

The same procedure is used to operate the CRT with the three-layer second color-selection structure 31A as is used above for the CRT with the two-layer first structure 31 except that the third masking plate 61 is electrically connected to, and carries the same voltage as, the first masking plate 41A. By adding the third masking plate 61, the same but enhanced focusing and defocusing effect can be realized with a lower focusing voltage ($\Delta V$), usually about 300 volts and with similar electrostatic fields. The foregoing CRT is to be compared with tubes having a three-layer color-selection structure disclosed in the above-cited application of C. A. Catanese et al. Instead of two arrays, each of many separate conductors, attached to opposite sides of an apertured masking plate, the use of three apertured masking plates in the novel tubes permits easier fabrication and better dimensional stability during the operation of the tubes.

Another alternative quadrupolar-focusing color-selection structure is a three-layer construction for the novel CRT that is not shown in the drawings. This third color-selection structure is similar to the structure shown in FIG. 4, except that the designs of the central masking plate and the two center masking plates are reversed. That is, the central masking plate has the design of the first and third masking plates 41A and 61 of FIG. 4, and the outer masking plates have the design of the second masking plate 47A of FIG. 4. A tube with such a color-selection structure may be operated in the same manner as a tube with the color-selection structure shown in FIG. 4.

Figure 5:
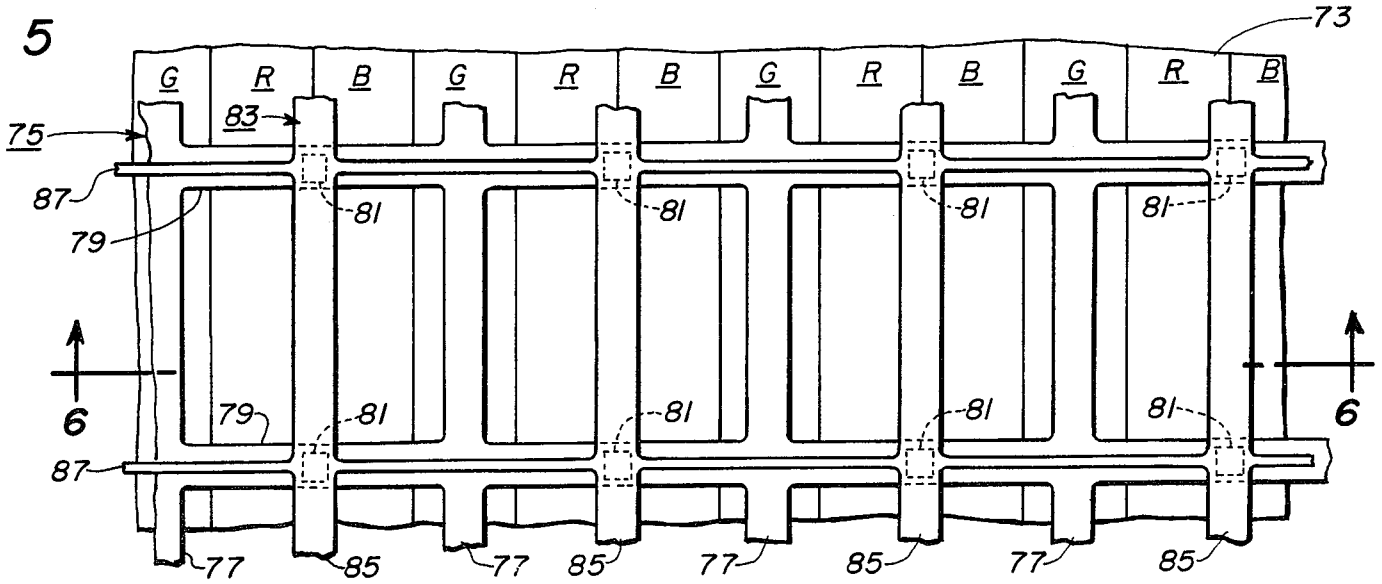
FIG. 5 is a plan view of fragments of a two-layer quadrupolar-focusing-and-dipolar-deflecting color-selection structure and the viewing screen therefor that may be substituted in the CRT shown in FIG. 1.
Figure 6:
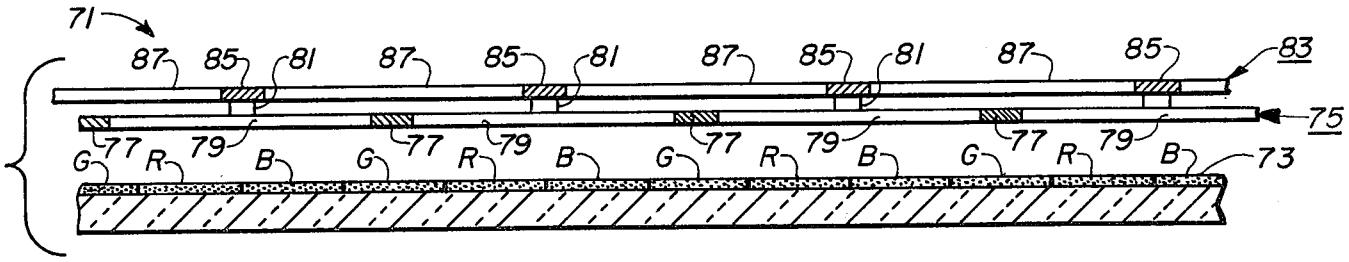
FIG. 6 is a sectional view of the fragments shown in FIG. 5 viewed along section lines 6—6.

FIGS. 5 and 6 illustrate, in a fourth embodiment of the novel CRT, a fourth color-selection structure 71, which provides both dipolar deflecting and quadrupolar focusing of the electron beamlets and an associated viewing screen 73. The fourth color-selection structure 71 may be substituted for the first color-selection structure 31 in FIG. 1 with the relationships described below. The screen 73 comprises a large number of red-emitting, green-emitting and blue-emitting phosphor stripes R, G and B arranged in color groups as in the first embodiment.

The color-selection structure 71 of this fourth embodiment comprises a first masking plate 75 about 0.10 mm thick facing, and precisely spaced from, the viewing screen 73. The first masking plate 75 has a large number of rectangular first apertures or openings therein defined by first vertical webs 77 that are about 0.10 mm wide and about 0.75 mm on center and, orthogonal thereto, horizontal webs 79 that are about 0.175 mm wide and about 0.45 mm on center. The first apertures are arranged in columns, which are parallel to the long direction of the stripes R, G and B, there being one column of first apertures associated with each triad of stripes. The first vertical webs 77 are centered over the green stripes G of the screen 73. The red stripe R is to the right and the blue stripe B is to the left of the green stripe G as viewed from the electron-beam-producing means 35 of FIG. 1.

The fourth color-selection structure 71 also comprises a second masking plate 83 about 0.10 mm thick spaced from the first masking plate 75 by solid conductors 81 that are about 0.025 to 0.050 mm thick and less than 0.10 mm at their greatest horizontal dimension. The second masking plate 83 has a large number of second rectangular openings or apertures therein defined by second vertical webs 85 about 0.10 mm wide and about 0.75 mm on center and, orthogonal thereto, second horizontal webs about 0.05 mm wide and about 0.45 mm on center. The centers of the second vertical webs 85 are centered over the first apertures in the first masking plate 75. The centers of the second horizontal webs 81 are centered over the centers of the first horizontal webs 79.

Because of the foregoing geometric and dimensional relationships, the fourth color-selection structure has therein, in parallel vertical columns, an array of windows which are defined by the first vertical webs 77, the second vertical webs 85 and the first horizontal webs 79. The windows are functionally electron-beam-transmitting ports, there being two horizontally coadjacent columns of windows opposite each triad.

To operate the CRT, the electron-beam-producing means is energized with the cathode at essentially ground potential. A first positive voltage (V) of about 25,000 volts is applied to the screen 73 and the first masking plate 75, and a second positive voltage ($V-\Delta V$) of about 25,000 volts minus an optimized focusing voltage ($\Delta V$), which is usually about 500 volts, is applied to the second masking plate 83. Three convergent beams are made to scan a raster on the viewing screen 73. Each beam approaches the first masking plate 75 at a different angle producing many beamlets as it passes through the windows. The electrostatic fields produced by the applied voltages cause the beamlets to be compressed or focused horizontally and expanded or defocused vertically. Also, beamlets passing through the adjacent windows on each side of the first vertical webs are deflected towards one another so that they fall on the same stripe.

The foregoing operation is to be compared with the CRTs and the modes of operation disclosed in U.S. Pat. Nos. 4,207,490 and 4,316,126, op. cit., where at least one array of parallel-spaced conductors is employed as separate pieces. In the fourth color-selection structure, there are no separate conductors. Instead, each array of conductors is replaced with a complete masking plate comprising an integral grid of webs, which plate is more easily fabricated, and the webs therein maintain their relative positions more precisely.

Figure 7:
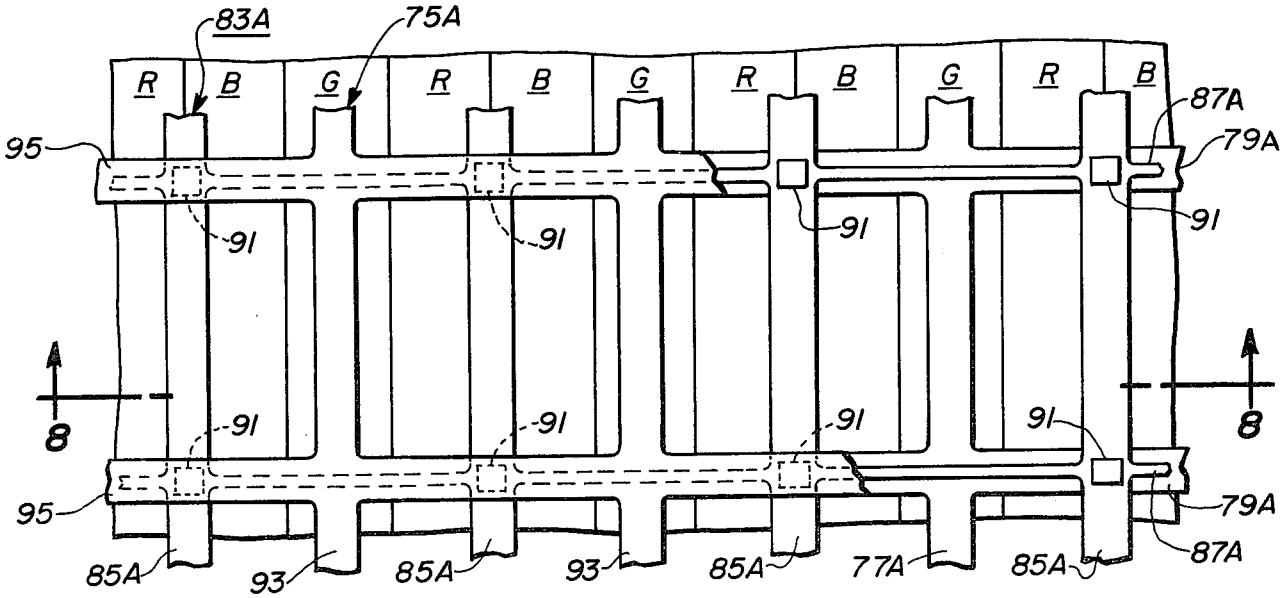
FIG. 7 is a plan view of fragments of a three-layer quadrupolar-focusing-and-dipolar-deflecting color-selection structure and the viewing screen therefor that may be substituted in the CRT shown in FIG. 1.
Figure 8:
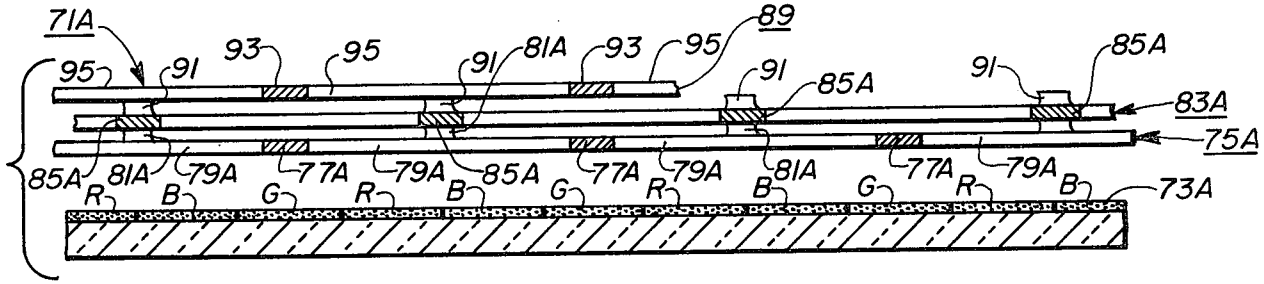
FIG. 8 is a sectional view of the fragments shown in FIG. 7 viewed along section lines 8—8.

A three-layer dipolar-deflection and quadrupolar-focusing color-selection structure 71A for the novel CRT is shown in FIGS. 7 and 8 as a fifth embodiment. The structure is similar to the fourth embodiment shown in FIGS. 5 and 6 except that a third masking plate 89 is spaced from the second masking plate 83A by solid conductors 91 that are about 0.025 to 0.050 mm thick. In FIGS. 7 and 8, structural parts that are similar to those in FIGS. 5 and 6 bear the same reference numerals followed by an A. The third masking plate 83 is substantially identical in design to the first masking plate 75A, having a large number of third rectangular apertures therein which are defined by third wide (0.10 mm) vertical webs 93 and, orthogonal thereto, third wide (0.10 mm) horizontal webs 95. The third masking plate 89 is positioned opposite the first masking plate 75A.

The same procedure is used to operate the CRT with the three-layer fifth color-selection structure 71A is used above for the CRT with the two-layer fourth structure 71 except that the third masking plate 89 is electrically connected to, and carries the same voltage as, the first masking plate 75A. By addiing the third masking plate 89, the same but enhanced focusing and defocusing effects can be realized with a lower focusing voltage ($\Delta V$), usually about 300 volts and similar electrostatic fields. The foregoing CRT with the fifth color-selection structure shown in FIGS. 7 and 8 is to be compared with tubes having a three-layer-selection structure disclosed in U.S. Pat. No. 4,311,944, op. cit. Instead of two arrays of separate conductors attached to opposite sides of a masking plate, the use of three masking plates in the novel tubes permits easier fabrication and better dimensional stability during the operation of the tubes.

What is claimed is:

1. A cathode-ray tube including (a) a target comprising an array of phosphor elements of different emission colors arranged in cyclic order in adjacent color groups, each group comprising an element of each of said different emission colors, (b) means for producing a plurality of electron beams directed toward said target, and (c) a color-selection structure positioned between said target and said beam-producing means, said color-selection structure producing a plurality of quadrupolar-focusing lenses, when operating voltages are applied to said structure, each lens defining a substantially rectangular window for transmitting portions of said beams to an associated color group of said target, said structure comprising (i) a first metal masking plate having therein a first array of substantially rectangular apertures and (ii) a second metal masking plate insulatingly spaced from said first masking plate with solid insulators, and having therein a second array of substantially rectangular apertures, the apertures of said first and second arrays being positioned relative to one another to produce said quadrupolar focusing lenses, and wherein each masking plate is a single metal layer consisting essentially of a first plurality of spaced parallel webs and a second plurality of spaced parallel webs orthogonal to said first plurality of webs, and one of the plurality of webs in at least one of said masking plates is electron-optically innocuous when operating voltages are applied to said color-selection structure.

2. The tube defined in claim 1 wherein the first plurality of webs in one of said plates is electron-optically innocuous and the second plurality of webs in the other of said plates is electron-optically innocuous, and said windows are defined by the second plurality of webs in said one of said plates and the first plurality of webs in said other of said plates.

3. The tube defined in claim 1 wherein the widths of the webs of said one of the plurality of webs are small relative to the widths of the opposite webs in said other plate so as to be electron-optically innocuous when operating voltages are applied to said color-selection structure.

4. The tube defined in claim 3 wherein the widths of the webs of said one plurality of webs are less than half the widths of the opposite webs in said other plate.

5. The tube defined in claim 4 wherein said windows are defined on two opposite sides by the full-width webs of one of said plates and on the other two opposite sides by full-width webs of the other of said plates whereby said windows have sharp corners with substantially no rounding.

6. The tube defined in claim 1 including (iii) a third metal masking plate insulatingly spaced from said first and second masking plates and having therein a third array of substantially rectangular apertures, the apertures of said first, second and third arrays being positioned relative to one another to produce said quadrupolar lenses.

7. The tube defined in claim 6 wherein the widths of the webs in one of the plurality of webs in each of the outer masking plates are small relative to the widths of the opposite webs in the center masking plate so as to be electron-optically innocuous when operating voltages are applied to said color-selection structure.

8. The tube defined in claim 6 wherein the widths of the webs in one of the plurality of webs of the center masking plate are small relative to the widths of the opposite webs in each of the outer masking plates so as to be electron-optically innocuous when operating voltages are applied to said color-selection structure.

* * * * *